US005328337A

United States Patent [19]

Kunta

[11] Patent Number: 5,328,337

[45] Date of Patent: Jul. 12, 1994

[54] GUIDED VANES HYDRAULIC POWER SYSTEM

[76] Inventor: Norbert J. Kunta, 68 Ronald St., Devonport, Tasmania 7310, Australia

[21] Appl. No.: 969,197

[22] PCT Filed: Aug. 17, 1990

[86] PCT No.: PCT/AU90/00354

§ 371 Date: Feb. 15, 1993

§ 102(e) Date: Feb. 15, 1993

[87] PCT Pub. No.: WO92/03636

PCT Pub. Date: Mar. 5, 1992

[51] Int. Cl.[5] ..... F01C 1/344; F04C 2/344; F04C 18/344

[52] U.S. Cl. ..... 417/310; 417/62

[58] Field of Search ..... 418/260; 417/62, 310

[56] References Cited

U.S. PATENT DOCUMENTS

| | | | |
|---|---|---|---|
| 1,666,466 | 4/1928 | Peters | 418/260 |
| 3,788,770 | 1/1974 | Johnson et al. | 417/62 |
| 4,913,102 | 4/1990 | Ohmura et al. | 417/310 X |
| 4,963,080 | 10/1990 | Hansen | 418/260 |

FOREIGN PATENT DOCUMENTS

| | | | |
|---|---|---|---|
| 136385 | 11/1947 | Australia . | |
| 164102 | 9/1953 | Australia . | |
| 164799 | 8/1954 | Australia . | |
| 220888 | 10/1957 | Australia . | |
| 31834/71 | 2/1973 | Australia . | |
| 536155 | 11/1980 | Australia . | |
| 558372 | 12/1982 | Australia . | |
| 29753 | 6/1981 | European Pat. Off. . | |
| 45322 | 2/1982 | European Pat. Off. . | |
| 1094280 | 5/1955 | France | 418/260 |
| 61-83492 | 4/1986 | Japan | 418/260 |
| 2129058A | 5/1984 | United Kingdom . | |

*Primary Examiner*—Richard E. Gluck

*Attorney, Agent, or Firm*—Vidas, Arrett & Steinkraus

[57] ABSTRACT

A hydraulic power system comprising a stator (1) having a non-circular cavity with inner wall (2) and a rotor (3) rotatably mounted in the cavity. The rotor (3) has a plurality of radially extending slots formed in its circumference and a vane (18) slidably mounted in each of the slots. Guide means (11) fixed relative to the stator (1) is arranged to guide the vanes (18) in and out of the rotor (3) as the rotor (3) rotates to keep the outer edge of the vanes (18) in sliding contact with the inner wall (2). Additionally, the system discloses a plurality of flow passages in the stator connected via a mode variation valve for series or parallel operation of the system, and a selector valve for changing the direction of operation which may be coupled to a by-pass valve for reducing the output of the system.

18 Claims, 8 Drawing Sheets

GUIDED VANES HYDRAULIC POWER SYSTEM

This invention relates to a hydraulic power system, and more specifically, to a hydraulic power system which has a rotor having vanes movable relative thereto. The system is specifically adapted for low to medium pressure applications.

In many applications it is desirable that a power system operate under low to medium pressure, can be slow running, and has a high torque. An example of one such system is a hydraulic motor or winch used in the fishing industry for load lifting and lowering, net hauling and like operations. Preferably those motors have a great variation in rotational speed in both direction, an increase in torque output to match in increase in load, automatic stalling at high load, automatic paying-out when the stalling load is excuded, and automatic hauling in when the load is lower than the stalling load. It is also important that the motors have easy and flexible operation with a minimum of controls, are not subjected to shock loading when changing directions and are of sturdy construction.

Clearly there are many different applications for a hydraulic power system, but it is an object of this invention to provide a power system which is capable of satisfying at least some of the above requirements.

According to the invention there is provided a hydraulic power system comprising a stator having a central cavity with a wall of non-circular cylindrical shape, a rotor rotatably mounted in said cavity, a plurality of slots formed in said rotor, said slots being evenly spaced around the periphery of the rotor and said slots extending radially inwards from the periphery of the rotor, a vane located in each of said slots, said vanes being slidable in said slots between outwards and inwards positions, said vanes having an outer edge arranged to be in contact with said wall, guide means being fixed relative to said stator for positively displacing said vanes as said rotor rotates in use, said guide means being arranged to keep said outer surface of said vanes in sliding contact with said wall during said rotation, and at least two fluid passages extending into said cavity through which operating fluid can be introduced into and removed from said cavity.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 1:
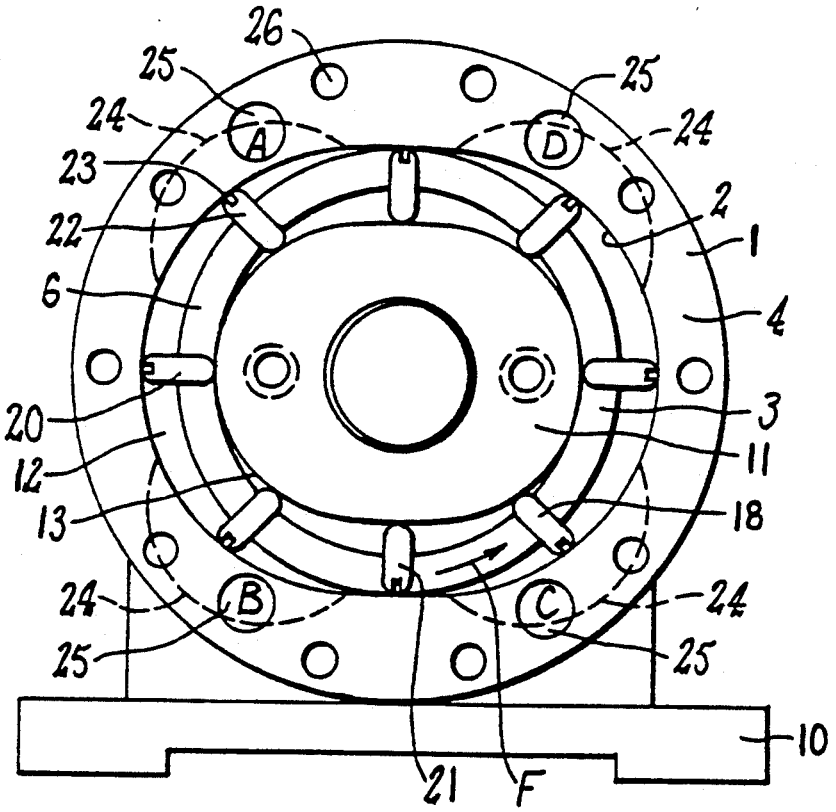
FIGS. 1 and 1A are end and side views respectively of a motor according to the invention, the end view being shown with one end plate removed such that the internal arrangement of components can be viewed.
Figure 1A:
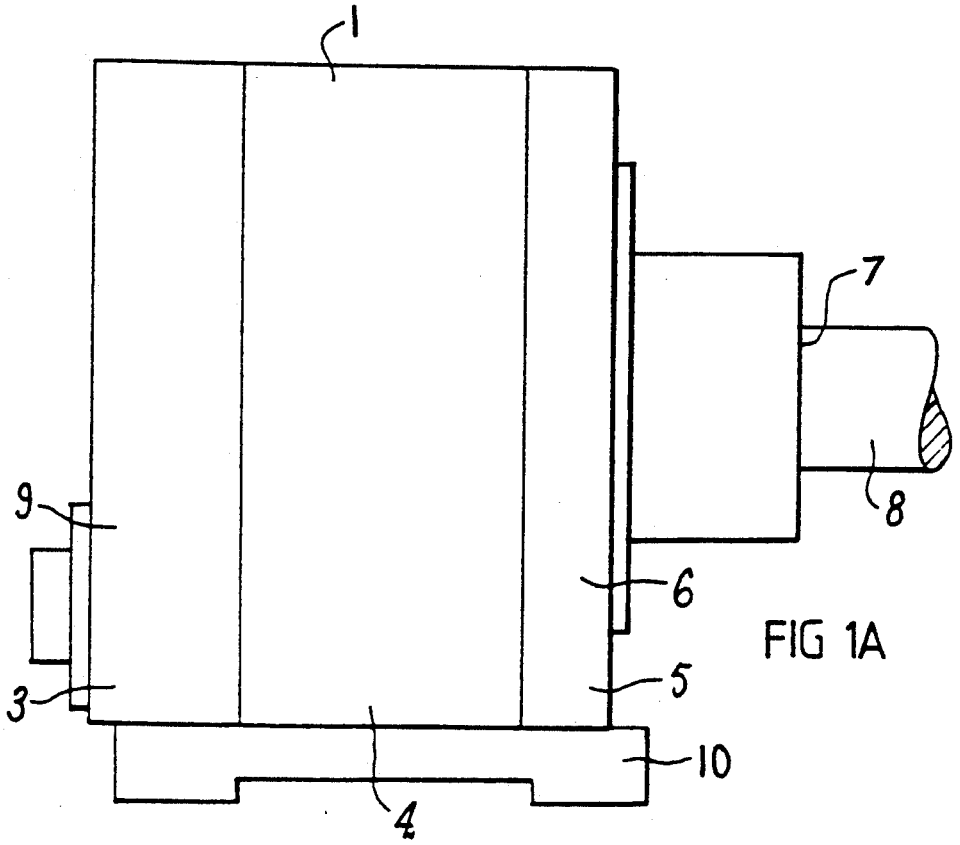

Referring initially to FIGS. 1 and 1A, a hydraulic motor comprises a stator 1 having a central cavity 2 in which a rotor 3 rotates in use. The wall of the cavity 2 in the stator 1 is of cylindrical form having a twin centered symmetric elliptical shape. The stator 1 comprises a central portion 4 with the cavity formed therein and two end plates 5 which close off each side of the cavity. One of the end plates 6 has an opening 7 through which the shaft 8 of the rotor 3 extends. The other end plate 9 has various ducting channels therethrough as will be described hereinafter. The stator 1 is mounted on a base 10 which in turn can be mounted to a suitable footing or the like.

Each end plate 5 carries an oval shaped guide plate 11 which is bolted to the inner wall of the end plate 5 and is shaped complementarily to the inner wall of the cavity 2. That is, when the end plates are mounted to the central portion 4, a uniform width guide track 12 is defined between the peripheral edge 13 of the guide plates 11 and the wall of the cavity 2. That oval shaped guide track 12 is clearly shown in FIG. 1.

Figure 2:
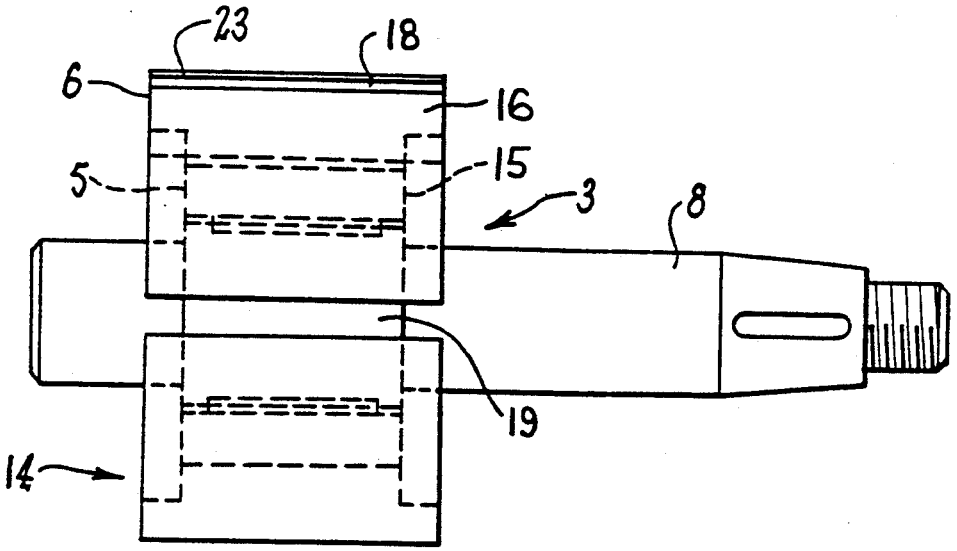
FIGS. 2 and 2A are side end views respectively of a rotor for the motor of FIG. 1.
Figure 2A:
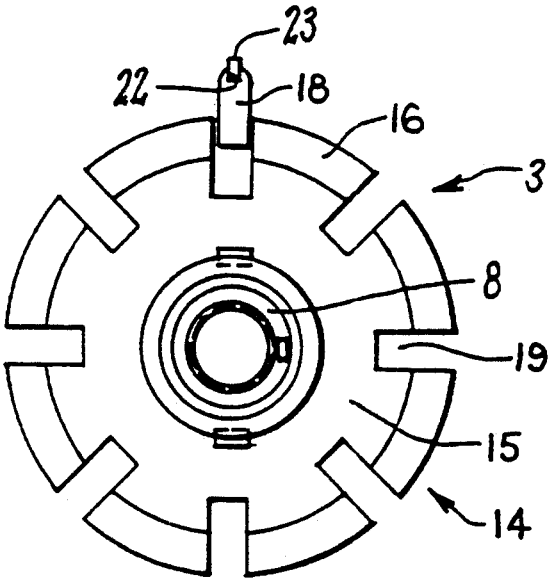

The rotor 3 which is shown in FIGS. 2 and 2A in detail includes the shaft 8 having a rotor head 14. That head 14 is of circular form and is coaxial with the shaft 8. The head 14 includes a recess 15 at each end thereof, the two recesses being of circular shape and coaxial with the axis of the shaft 8. A shoulder 16 is thus formed around the periphery of the head portion 14 and that shoulder 16 locates in the guide track 12. The inner diameter of that shoulder 16 is substantially the same dimension as the long diameter of the guide plate 11 and the outer diameter of the shoulder 6 is substantially the same dimension as the smaller diameter of the cavity 2.

The rotor head 14 carries a plurality of vanes 18 (only one of which is shown in FIGS. 2 and 2A) which locate in slots 19 formed around the periphery of the head 14. The vanes 18 are able to slide in the slots 19 between an outer position as indicated at numeral 20 in FIG. 1 and an inner position as indicated by numeral 21 in FIG. 1. As the rotor rotates in use, the vanes, the end regions of which locate in the guide track 12, are positively displaced by that guide track to move between the inner and outer positions. The radially outer edge of the vanes have a small groove 22 running the length thereof and a teflon strip 23 or other wear resistant sealing element is located in that groove 22. The teflon strip 23 seals with the inner face of the cavity 2 and in use slides smoothly on the stator.

The manner in which the vanes 18 are positively displaced in the slots ensures that the vanes 18 smoothly follow in the guide track 12 as the rotor rotates. The vanes 18 are not assisted in this movement by springs or fluid pressure, and the end regions of the vanes 18 slide smoothly in the guide tracks 12, lubricated by the operating fluid used to drive the motor.

The stator has a plurality of pressure chambers 24 formed therein and those pressure chambers 24 are preferably recessed relative to the inner wall of the cavity 2 as depicted in FIG. 1. Fluid passages formed in the end plate 9 are in communication with those pressure chambers 24. In the embodiment shown there are four pressure chambers 24 and for ease of description those chambers have been given the letters "A", "B", "C" and "D" as indicated in FIG. 1. The central portion 4 has four communication passages 25, each in communication with a separate pressure chamber 24, the communication passages 25 extending parallel to the rotational axis of the rotor 3 and each being in communication with passages in the end plate 9, as described hereinafter.

The stator is provided with bolt holes 26, and bolts (not shown) are used to bolt the two end plates onto the central portion 4.

Figure 3:
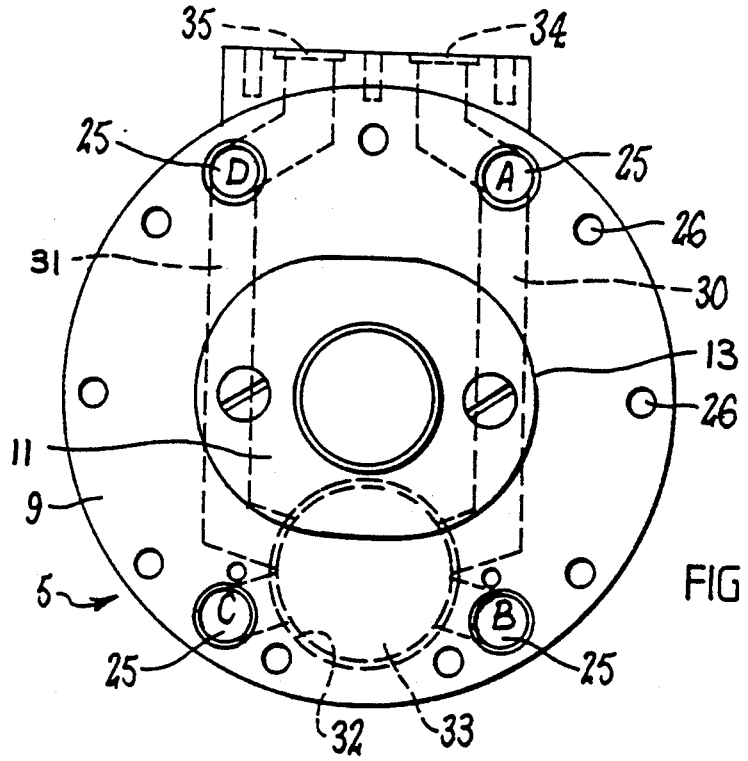
FIG. 3 shows an end plate for the motor of FIG. 1 wherein the passages through that end plate are depicted by dotted lines.

FIG. 3 depicts the end plate 9 from the inner side thereof with the passages 25 which when the motor is assembled are in communication with pressure chambers 24 shown thereon. In the drawings the letters "A", "B", "C" and "D" will be used to indicate that a passage, or port, is in communication with the respective pressure chamber "A", "B", "C" and "D". In FIG. 3, the guide plate 11 is shown secured to the end plate 9. The end plate 9 has two main passages 30 and 31 formed therein and those passages 30 and 31 both lead to a mode variation chamber 32 in which a rotary mode variation valve 33 is located. Passage 30 is also in communication with port 34 which is an inlet port when the motor is operating in the forward direction and passage 31 is in communication with another port 35 which is an outlet port when the motor is operating in the forward direction. When the motor is operating in reverse, the port 35 will be an inlet port and the port 34 will be an outlet port.

Figure 8:
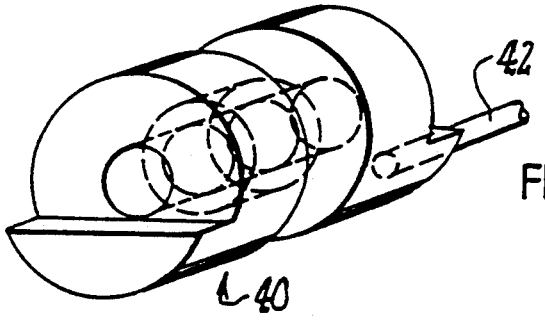
FIGS. 8 and 8A show a diagrammatic perspective view of a selector valve and its chamber, respectively, for the motor of FIG. 1.
Figure 8A:
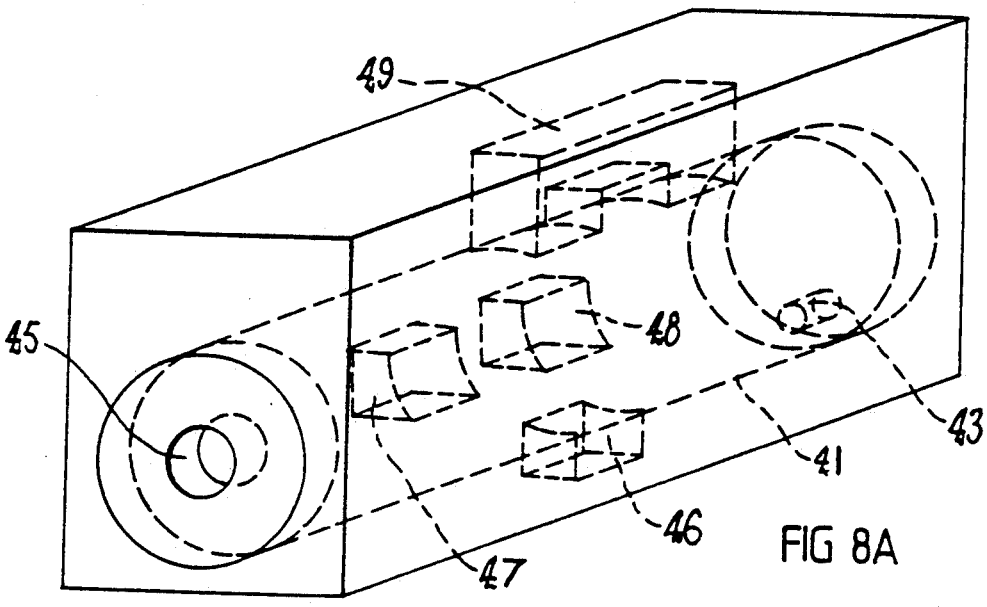

One possible means by which the direction of rotation of the motor can be altered is depicted diagrammatically in FIGS. 8 and 8A. FIG. 8 shows a piston type selector valve 27 comprising a piston 40, and a cylindrical valve chamber 41 in which the piston 40 slides is shown in FIG. 8A. The exact configuration of that piston 40 and the communication passages which connect into the valve chamber 41 will be described in more detail With regard to FIGS. 10 to 19 of the drawings. Suffice, at this stage, is to state that the piston 40 is able to slide back and forth in the valve chamber 41 and a manipulating spindle 42 is connected to the piston for sliding the piston 40 back and forth. That spindle 42 passes through a bore 43 formed in the valve chamber 41 and the spindle is accessible from outside the valve chamber 41 for manual or powered manipulation of the piston. A fluid inlet 45 is provided into the valve chamber 41 and a fluid outlet 46 provides the passage through which fluid which has driven the rotor 3 exits from the motor and returns to a reservoir for the fluid pressurization means (not shown). Ports 47 and 48 from valve chamber 41 connect to ports 34 and 35 respectively. A transfer passage 49 conveys fluid between opposite sides of the piston 40, depending on the position of the piston. Thus, the piston 40 can be moved back or forward in the cylinder 41 in order to direct pressurized fluid from the inlet 45 to one or other of the ports 47 or 48, depending on whether it is desired to rotate the motor in forward or reverse direction. In the central position of the piston 40 the fluid flows from the inlet 45, through the piston 40, and directly out of the outlet 46. In all positions of the piston 40 flow through the inlet and return through the outlet is full flow, that is, the piston 40 does not form any constriction and serves only to direct the flow through the motor in forward or reverse direction, or directly through to return, depending on the position of the piston. Thus, maximum fluid flow is always available to drive the motor, and movement of the piston 40 between forward and reverse positions results in a stepless variation of fluid flow through the motor.

Figure 5A:
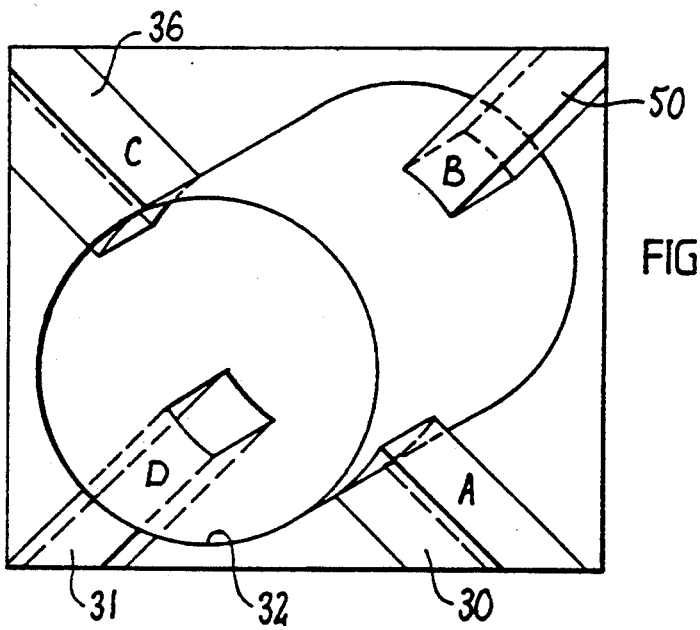
FIGS. 5 and 5A show a diagrammatic perspective view of a mode variation valve and its chamber, respectively, for the motor of FIG. 1.
Figure 5:
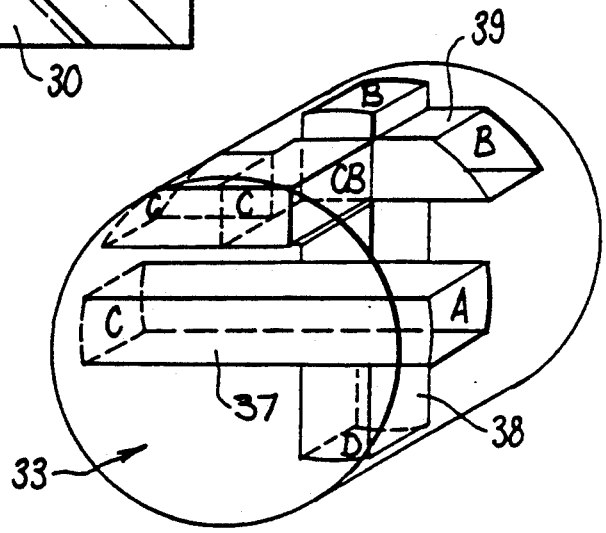
Figure 6:
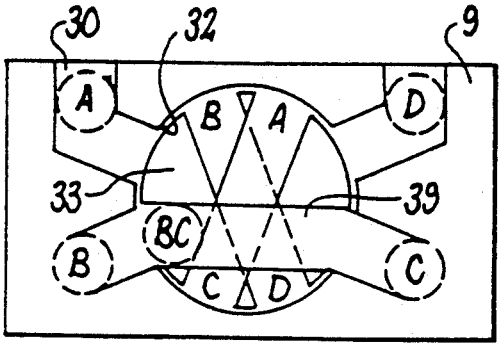
FIGS. 6 and 7 show diagrammatic end views of the mode variation valve in two different operational modes.
Figure 7:
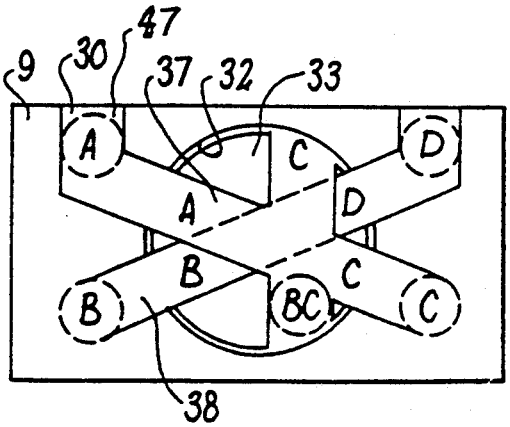

A mode variation valve is depicted in FIGS. 5 and 5A of the drawings. The mode variation valve is used to change the mode of operation of the motor between parallel mode and series mode. In parallel mode, two opposite pressure chambers 24 are-supplied with pressurised fluid, and in series mode, three pressure chambers 24 are supplied with pressurized fluid. That valve is indicated generally by the numeral 33, shown in FIG. 5, locates in a chamber 32 shown in FIG. 5A formed in the end plate 9. The chamber 32 has four fluid passages in communication therewith. Those passages being passages 30 and 31 in communication with pressure chambers "A" and "D" respectively and passages 50 and 36 in communication with pressure chambers "B" and "C" respectively. The mode variation valve 33 locates in the chamber 32 and is rotatable in that chamber 32 in order to alter the connections between fluid passages 30, 31, 36 and 50. There are basically three different fluid passages through the valve 33. The first passage is indicated at numeral 37 and in one position of the valve connects the pressure chamber "A" with the pressure chamber "C". When the rotary valve is in that position, the second fluid passage 38 connects the pressure chamber "B" with the pressure chamber "D". The valve is shown in that position diagrammatically in FIG. 7 and with the valve in that position the motor will operate in parallel mode. The third passage 39 through the valve 33 connects the pressure chamber "B" with the pressure chamber "C". That second position of the valve is indicated diagrammatically in FIG. 6, and with the valve in that position the motor will operate in series mode. Thus, by simply rotating the valve 33 to the position shown in either FIG. 6 or 7 the motor can be operated in parallel or series mode as required.

Figure 10:
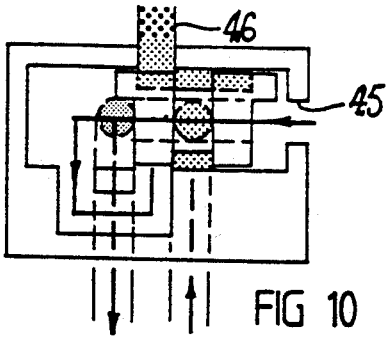
FIGS. 10 to 14 show five different positions of the selector valve for the motor in parallel mode of operation.
Figure 12:
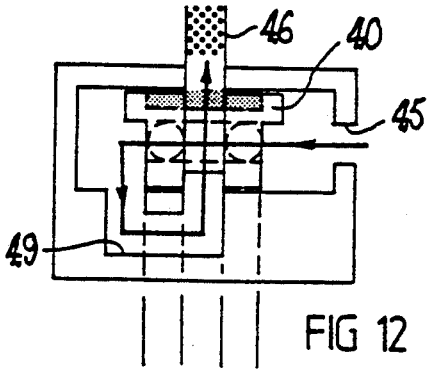
Figure 11:
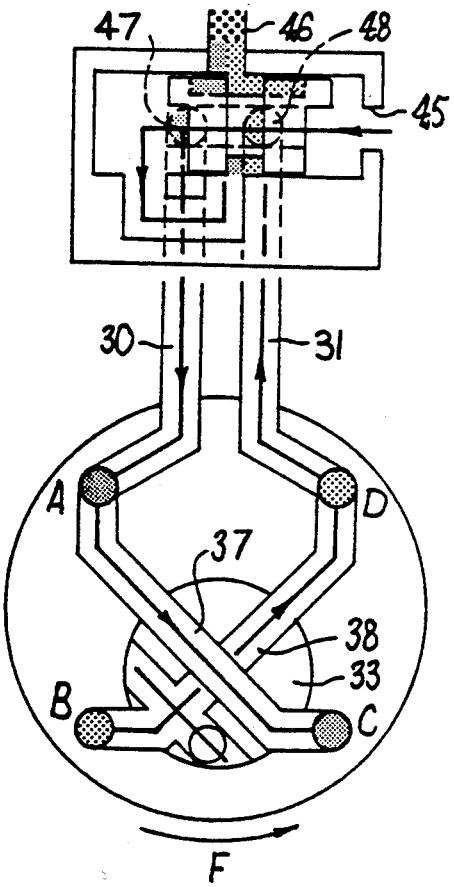
Figure 13:
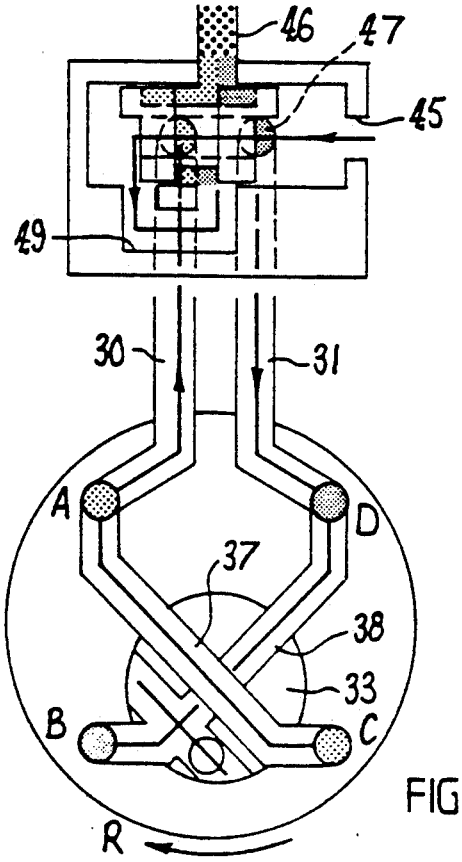
Figure 14:
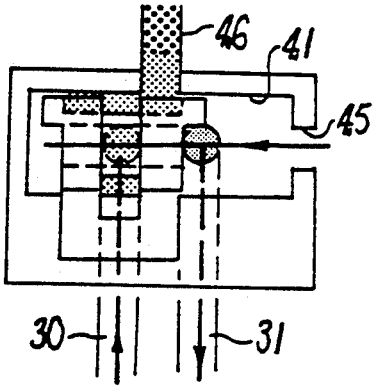
Figure 15:
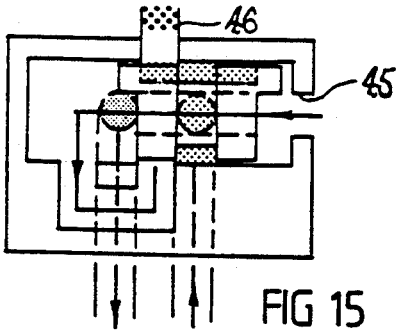
FIGS. 15 to 19 show the selector valve in five different positions with the motor in the series mode of operation.
Figure 16:
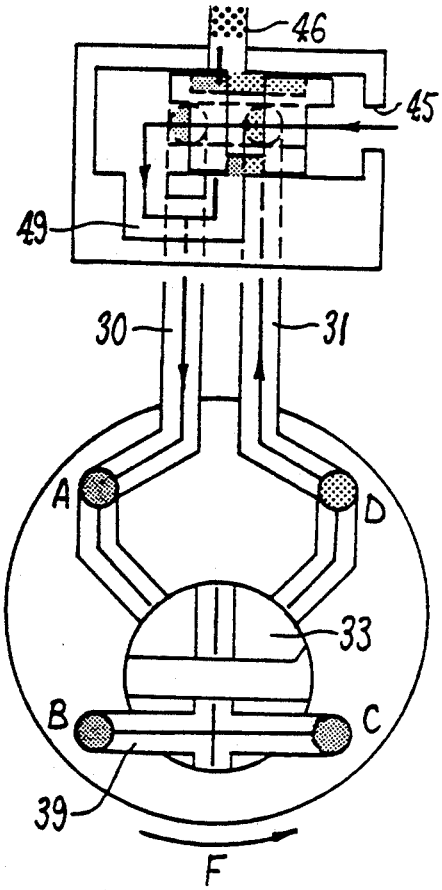
Figure 17:
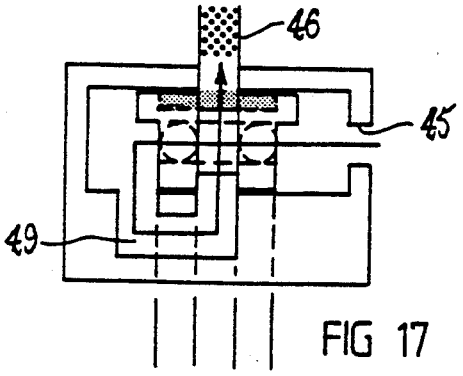
Figure 18:
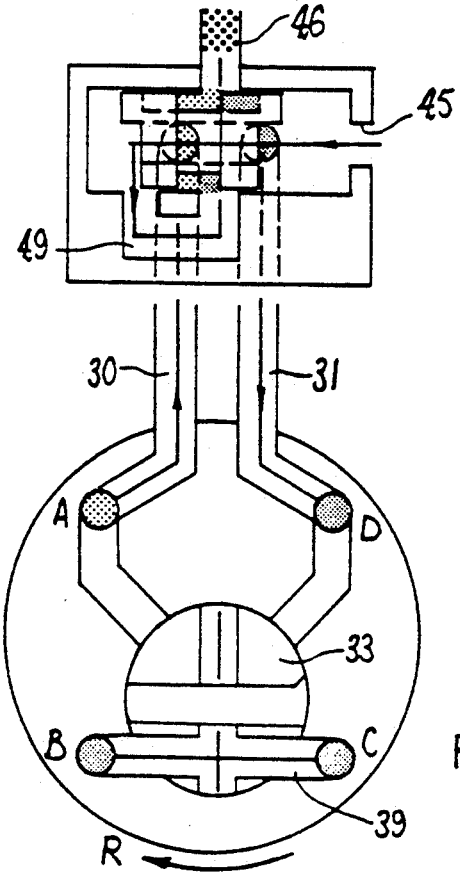
Figure 19:
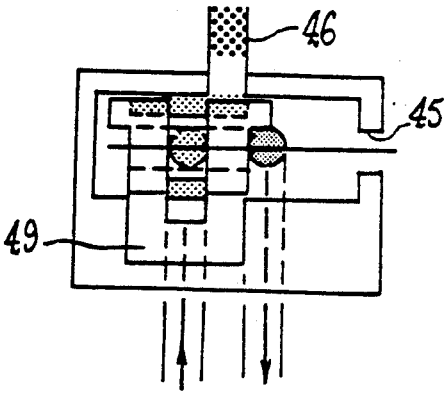

FIGS. 10 to 14 indicate how the selector valve is used to alter, in a stepless manner, the direction of rotation of the rotor when the mode variation valve 33 is in the parallel mode position. In FIG. 10 with the selector valve 27 adjacent the inlet 45 fluid under pressure flows through the selector valve 27 into passage 31 through mode variation valve 33 to pressure chamber "B". Return fluid passes from pressure chambers "C" and "A" through passage 30 to then pass through the selector valve 27 and out through the outlet port 46. FIG. 11 shows the selector valve moved somewhat away from the inlet side of the cylinder 41 so that a portion of each of the ports 47 and 48 are closed by the selector valve, thereby reducing the percentage of pressurised fluid that is being introduced into the pressure chambers "D" and "B" and accordingly reducing the power of the motor. In FIG. 12 the selector valve 27 has moved further away from the inlet 45 to a position where the selector valve 27 closes off both of the ports 47 and 48 and pressure fluid passes through the inlet, through a central passage in the piston 40, through the transfer passage 49 and out through the outlet port 46. In the FIG. 12 position the motor is thus not driven although pressurized fluid passes between ports 45 and 46. In the position as shown in FIG. 13 the piston 40 has moved still further away from the inlet port 45 to an intermediate position where pressurised fluid is now introduced through port 47 into passage 30 in order to drive the rotor in a reverse direction. In this reverse direction, a percentage of the pressurised fluid passes through the transfer passage 49 and out through outlet port 46 without passing through the motor. In FIG. 14 the piston 40 has been moved fully away from the inlet port 45 to a position where the rotor is driven at full power and speed in the reverse direction and all pressure fluid passing into the cylinder 41 passes through the passage 30 to drive the rotor. Return fluid passes through passage 31 back through the piston 40 and out through outlet 46. Thus, by varying the position of the selector valve 40, the rotor can be caused to rotate in either forward or reverse directions. With the selector valve in one of the intermediate position a portion of the pressurised fluid simply passes through the selector valve out through outlet port 46 back to a fluid reservoir for the high pressure fluid supply means, and the remaining fluid is used to drive the rotor. Those intermediate positions of the selector valve allow the rotor to be driven in either direction at reduced speed or reduced power and in sliding the piston between the full forward or full reverse positions the flow, changes through the passages are gradual.

FIGS. 15 to 19 depict corresponding positions of the selector valve to those that are shown in FIGS. 10 to 14 but in FIGS. 15 to 19 the mode variation valve 33 is in the series mode position. In the series mode position, forward direction, high pressure fluid is supplied to pressure chambers "D" and "B" whereas chamber "A" serves as a return chamber.

It will be appreciated that the selector valve 27 is used to allow full fluid flow to pass through the motor, or in an intermediate position it can divert and dump a percentage of the hydraulic fluid back to the reservoir without that fluid being used to drive the motor. The selector valve 27 operates in a stepless manner so that hydraulic shock which would occur with different types of valves is avoided. Clearly if a plurality of motors are mounted together the diverted percentage of fluid can be used to drive other motors rather than simply being dumped to the reservoir.

The selector valve 27 can take any convenient configuration but it is envisaged that a piston or shuttle type valve will allow for the smoothest operation, and will allow full flow in both forward and reverse directions. It will also close ports 47 and 48 in the central position, dumping the entire flow of fluid being introduced through inlet 45. It will also be apparent that as the piston 40 slides between open and closed positions, both ports 47 and 48 are always open to exactly the same extent and thus fluid entering inlet 47 is able to exit through outlet 48.

The mode variation valve 33, as previously mentioned, is used to alter the mode of operation of the motor. The mode can be either parallel mode or series mode, and the valve 33 is rotated, either manually or by power, so that one or other of the two modes is selected.

It will also be appreciated that the mode variation valve could be omitted altogether. That is, the passages in the end plate 9 could be either in a series mode configuration or a parallel mode configuration. This would mean that the operational range of the motor would be reduced, but the motor would be simpler to manufacture, and have fewer moving parts. If the mode variation valve were omitted, and the motor was a parallel configuration motor, passage 31 would simply link chambers D and B directly, and passage 30 would link chambers A and C directly. If, with the mode variation valve omitted, and the motor was to operate in series mode, a single passage 39 would link chambers B and D.

In the following description of both the parallel mode and series mode the motor will be described as operating in the forward direction. Clearly by simply moving the piston 40 to the opposite side of chamber 41 the motor will operate in the reverse direction and fluid will flow through the motor in the reverse direction.

Figure 9:
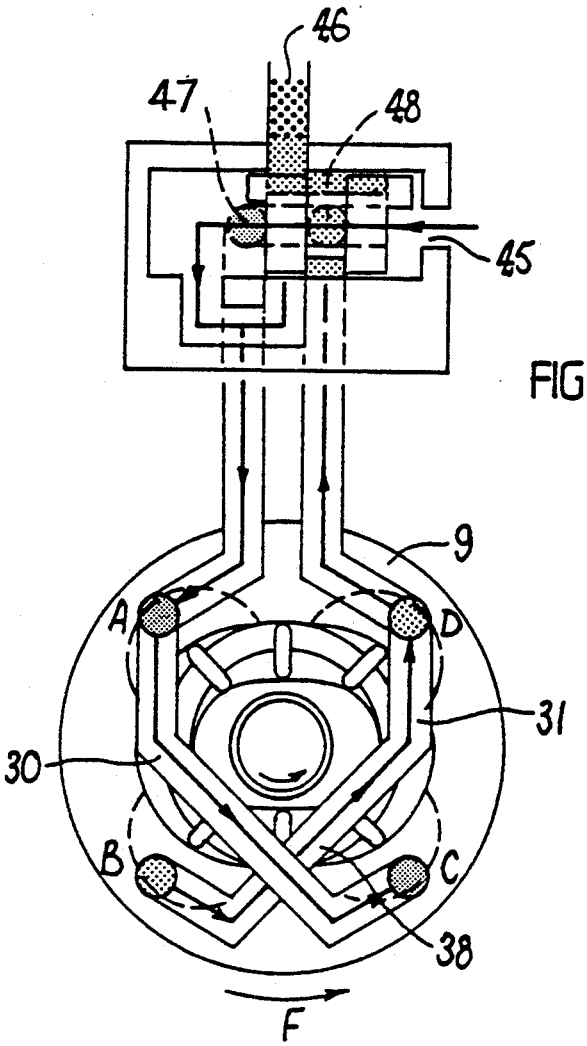
FIGS. 9 and 9A show in diagrammatic form, the selector valve and motor operating in parallel and series mode, respectively.

The parallel mode is a low speed mode and in that mode the mode variation valve is as depicted in FIG. 9. As shown, fluid flows into end plate 9 through port 47, into pressure chamber A and, along passages 30 and 31 to chamber C. As will be evident from FIG. 1, pressure fluid in chambers A and C will impinge against the vanes 18 and rotate the rotor in the direction of arrow F.

As the rotor rotates the fluid will pass to chambers B and D (from A and C respectively) and will then pass through passages 30 and 31 to exit through port 48 and out through port 46 to the reservoir.

Figure 9A:
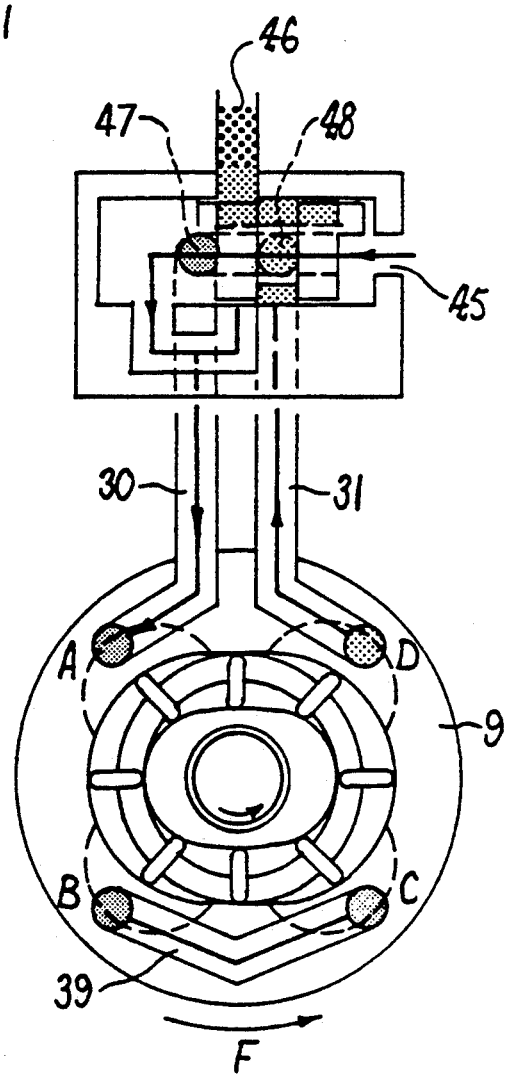

The series mode is a high speed mode and is depicted in FIG. 9A. In that mode fluid will enter the end plate 9 through port 47 and enter pressure chamber A. The mode variation valve will not link chambers A and C, but chambers C and B will be linked by passage 39. Fluid will flow out of the motor from chamber D. Thus, pressure fluid will enter chamber A causing the rotor to rotate, and the fluid will then reach chamber B. From chamber B it will pass to chamber C through passage 39, and from chamber C it will again cause the rotor to rotate until the fluid reaches chamber D from where it will exit the motor.

The fluid impinging on the vanes 18 in both parallel and series mode will do so on diametrically opposite sides of the shaft 8, that is, through two diammetrically opposed pressure chambers 24. The result is that there is no radial loading on the shaft 8, and thus the shaft has only to transmit the torque developed by the motor.

Figure 4:
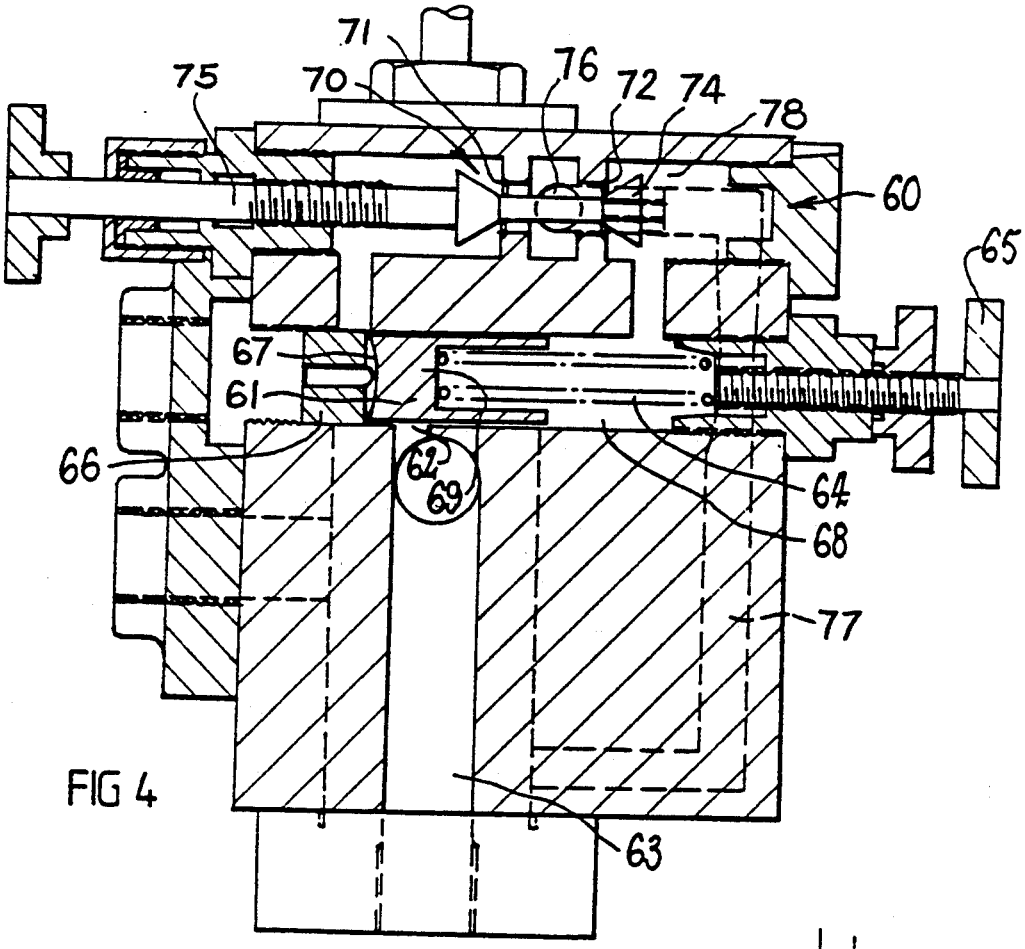
FIG. 4 shows a plan view of a by-pass valve for the motor of FIG. 1.

Clearly, it is not always desirable that all fluid supplied by the pressure supply means always enters the motor and for this reason a by-pass valve may be incorporated into the system. One type of by-pass valve is depicted in FIG. 4 of the drawings. That by-pass valve 60 is adapted to operate in conjunction with the selector valve 27 previously described herein but other arrangements are also possible. For example, it would be possible for the by-pass valve to be quite separate from the motor. The by-pass valve 60 shown in FIG. 4 is designed to provide an adjustable, regulated pressure fluid supply by dumping a selected quantity of pressure fluid to the return line prior to that fluid entering the motor. The valve 60 has a free-floating piston 61 which operates to slide over a port 62, thereby closing that port, the port 62 being connected to a return passage 63. The piston 61 is spring biased to a closed position by a compression spring 64, and a screw adjustment 65 is provided for varying the force of that spring bias. Hydraulic fluid in chamber 66 in the system acts on the face 67 of the piston 61 opposite to the spring 64 to thereby move the piston 61 against the action of the spring 64. When the pressure in the chamber 66 is high the fluid will move the piston 61 to compress the spring 64 and open the port 62. Back pressure in chamber 68 acts on the opposite face 69 of the piston to assist the spring 64 in moving the piston 61 to a closed position. Depending on the relative fluid pressures in chambers 66 and 68 the piston 61 will either be in an open or closed position.

The relative pressure in chambers 66 and 68 is controlled by a twin cone control valve 70 located in a valve chamber 78. That valve 70 includes a pair of oppositely facing seats 71 and 72, and the twin cones 73 and 74, which are axially aligned and taper convergently towards each other, are arranged to engage with those seats respectively. The inlet 76 into the valve 70 is located between the seats 71, 72. The cones 73, 74 are mounted on a spindle 75 which is screw threaded, and moving the spindle towards the right, in FIG. 4, causes cone 73 to engage seat 71 and thereby causes a drop in pressure in chamber 66. Moving the spindle towards the left in FIG. 4 causes seat 71 to be opened and seat 72 to close resulting in an increase in pressure in chamber 66.

The inlet 76 into the by-pass valve 70 is linked to the inlet 45 into the selector valve 27 by a passage 77. The outlet passage 63 from the by-pass valve 60 is connected to the outlet 46 from the chamber 41. Thus, when fluid flows through the by-pass valve it flows through passage 77, through inlet 76, past valve seat 71, into chamber 66, through port 62 and passage 63 to join with outlet passage 46. However, when the spindle is moved to the right the seat 71 is closed and fluid pressure in chamber 68 keeps port 62 closed. In this closed position all fluid flowing into the motor will pass through the selector valve 27. Clearly it is possible for there to be intermediate positions of by-pass valve 60, and the adjustable force provided by adjustment screw 65 on spring 64 will then determine at what point the by-pass valve opens.

Figure 4A:
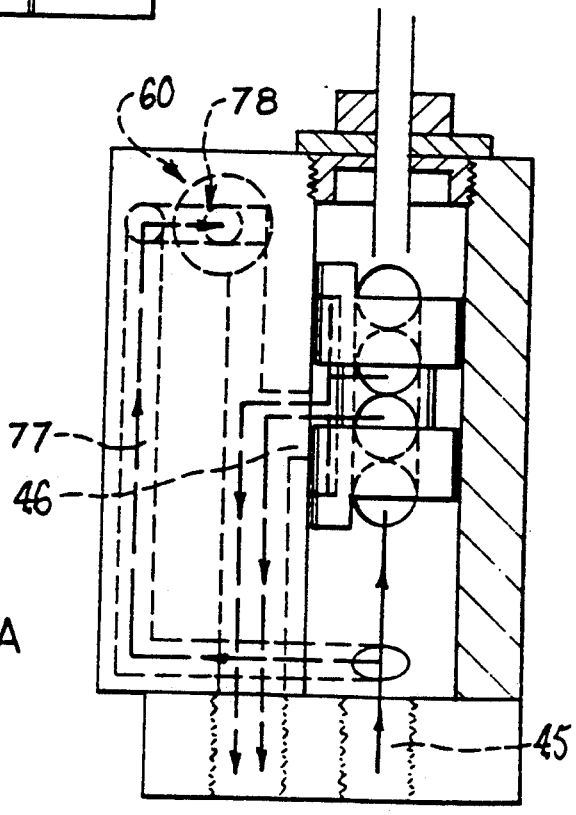
FIG. 4A shows how that by-pass valve connects to a selector valve.

FIG. 4A depicts how the by-pass, valve 60 may be linked to the selector valve 27, so that a percentage of fluid entering the inlet 45 is allowed to by-pass the selector valve along passage 77. The valve of that percentage is determined by the position of spindle 75 which controls the position of the cones 73 and 74 relative to seats 71 and 72.

Clearly there are many different types of power systems that can be made using aspects of the system as set out above. Power systems using the invention may, for example, be used in the fishing or marine industries where a supply of fluid is readily available. However, the invention is not limited to those uses, and it is specifically envisaged that the power system may be used as a pump or the like, or may be used to drive prime movers, or other machinery. The power system will, it is envisaged, be suitable for many applications where a source of rotational energy is required or is available.

Clearly, the size of the components and the operating pressures will be selected with a view to the type of application for which the power system is required. It is also not essential that all three valves referred to above are present in any single system. Particularly for simple systems where less variable operating parameters are required, one or more of those valves may be omitted. For example, if a motor is required which need not be put into reverse the selector valve may be omitted.

It is envisaged that the system will have advantages over at least some prior art systems particularly since the vanes are positively displaced by the guide tracks between outwards and inwards positions, and no spring or fluid pressure assistance is necessary to act on the vanes. The whole system is relatively simple, and it is envisaged substantially maintenance free. The valves can be moved between terminal positions without causing hydraulic shock to the system or to associated components.

It will be appreciated that the invention provides a power system which is dynamically balanced, and is able to use a driving fluid of any suitable type including a wide range of liquids, and gases. With flexibility in sizes and configurations of components a wide variety of types of power systems can be made. Features of those systems can be variable speed in both directions of rotation, variable torque with increased load, and automatic torque sensitive rotation and unloading.

It will also be understood that the power system can be manufactured from a wide range of materials including various metals, ceramics, or high strength plastics materials. Also, the power range for the system is widely variable depending on both the valve arrangements and the size of components selected. The system can be used as a motor, pump or compressor.

Various alterations, modifications and/or additions may be introduced into the constructions and arrangements of parts previously described without departing from the spirit or ambit of the invention.

I claim:

1. A hydraulic power system comprising a stator having a central cavity with a wall of non-circular cylindrical shape, and defining two cavity ends, a rotor rotatably mounted in said cavity, a plurality of slots formed in said rotor, said slots being evenly spaced around the periphery of the rotor and said slots extending radially inwards from the periphery of the rotor, a vane located in each of said slots, said vanes being slidable in said slots between outwards and inwards positions, said vanes having an outer edge arranged to be in contact with said wall, guide means being fixed relative to said stator for positively displacing said vanes as said rotor rotates in use, said guide means being arranged to keep said outer surface of said vanes in sliding contact with said wall during said rotation, and at least two fluid passages extending into said cavity through which operating fluid can be introduced into and removed from said cavity, said power system have a selector valve for selectively altering the direction of operating fluid flow through said power system, said selector valve having a valve chamber, a fluid inlet thereto and a fluid outlet therefrom, a pair of ports between said fluid inlet and said fluid outlet in communication with said valve chamber, said fluid ports being connected to one of said fluid passages, and a valve member movable in said valve chamber relative to said fluid inlet and said fluid outlet between first and second positions, where with said valve member in said first position fluid is directed by said valve member from said fluid inlet into one of said ports, and fluid from the other of said ports is directed by said valve member to said fluid outlet, and in said second positions fluid is directed by said valve member in the reverse direction through said ports.

2. A hydraulic power system according to claim 1 wherein there are four pressure chambers spaced around said cavity in communication with said cavity, and said fluid passages connect to said pressure chambers.

3. A hydraulic power system according to claim 2 wherein alternate pressure chambers are on diametrically opposite sides of the axis of rotation of said rotor.

4. A hydraulic power system according to claim 1 including a closure means comprising a pair of end plates which close off each end of said cavity, said fluid passages passing through at least one of said end plates for at least part of the length of those passages.

5. A hydraulic power system according to claim 4 wherein said guide means comprises a guide track fixed to said closure means, said vanes have end regions on each end thereof which ride in said guide tracks, and during rotation of said rotor the vanes are kept in sliding contact with the wall of said cavity by said guide tracks.

6. A hydraulic power system according to claim 5 wherein said vanes have an elongate outer edge which is in contact with said walls and said edge carries a strip of wear resistant material.

7. A hydraulic power system according to claim 5 wherein the shape of the wall of said cavity is a twin centred eliptical shape and the guide tracks are of corresponding shape.

8. A hydraulic power system according to claim 2 wherein said fluid passages each lead to a mode variation valve, said mode variation valve having a plurality of linking passages passing therethrough, the mode variation valve being movable between at least first and second positions, the linking passages connecting the pressure chambers together in different configuration, depending on the position of the mode variation valve.

9. A hydraulic power system according to claim 8 wherein in said first position of said mode variation valve alternate pressure chambers are linked together by said linking passages.

10. A hydraulic power system according to claim 8 wherein in said second position of said mode variation valve said linking passages connect together two adjacent pressure chambers, and said fluid passages are connected to the other two pressure chambers.

11. A hydraulic power system according to claim 8 wherein said mode variation valve comprises a barrel rotatably mounted in a cylinder, and said linking passages pass through said barrel, and wherein in the barrel is rotated in the cylinder in order for the mode variation valve to adopt either its first or second position.

12. A hydraulic power system according to claim 1 wherein a by-pass valve is incorporated into the system, the by-pass valve comprising an inlet port, an outlet port, a communication orifice linking the inlet port and outlet port, a valve closure member movable relative to the orifice between a first position in which fluid communication through the orifice is possible and a second position in which fluid communication through the orifice is not possible, and operating means, operable to cause said valve member to adopt either its first or second position, said inlet port being connected to an operating fluid supply line for said power system, and said outlet port being connected to an operating fluid return line, the by-pass valve being adapted to allow a percentage of said operating fluid to by-pass said central cavity, the value of said percentage being determined by the operating means.

13. A hydraulic power system according to claim 12 wherein the valve member comprises a piston slidable in a cylinder and said outlet port is formed through a wall of said cylinder, and when said piston is in said second position it seals off said outlet port, said piston being spring based to said second position.

14. A hydraulic power system according to claim 13 wherein said inlet port is in fluid communication with said piston such that pressure in said inlet port acts on said piston to urge the piston to move in a direction against the action of the biasing spring from said second position to said first position.

15. A hydraulic power system according to claim 1 wherein said selector valve can be moved to a third position in which said valve member seals off said ports and fluid is directed by said valve member directly from said fluid inlet to said fluid outlet.

16. A hydraulic power system according to claim 1 wherein said valve chamber is cylindrical in form and said valve member comprises a piston slidable in said chamber, a plurality of communication passages being formed in said piston for directing fluid flow within said chamber.

17. A hydraulic power system according to claim 1 wherein the power system is adapted to provide a source of high pressure fluid.

18. A hydraulic power system according to claim 1 wherein the power system is adapted to provide rotational energy from a source of high pressure fluid.

* * * * *

UNITED STATES PATENT AND TRADEMARK OFFICE

CERTIFICATE OF CORRECTION

PATENT NO. : 5,328,337

DATED : July 12, 1994

INVENTOR(S) : Norbert J. Kunta

It is certified that error appears in the above—identified patent and that said Letters Patent is hereby corrected as shown below:

Column 2, line 47 delete "shoulder 6" and insert — shoulder 16 —.

Column 3, line 48 delete "With" and insert — with —.

Signed and Sealed this

Fourth Day of October, 1994

Bruce Lehman

*Attest:*

BRUCE LEHMAN

*Attesting Officer*

*Commissioner of Patents and Trademarks*